US009863632B2

(12) United States Patent
Pastore

(10) Patent No.: US 9,863,632 B2
(45) **Date of Patent: *Jan. 9, 2018**

(54) PROCESS FOR OPERATING A COAL-FIRED FURNACE WITH REDUCED SLAG FORMATION

(71) Applicant: Environmental Energy Services, Inc., Sandy Hook, CT (US)

(72) Inventor: Mark Pastore, Suffern, NY (US)

(73) Assignee: Environmental Energy Services, Inc., Sandy Hook, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/932,284

(22) Filed: Nov. 4, 2015

(65) Prior Publication Data

US 2016/0053993 A1 Feb. 25, 2016

Related U.S. Application Data

(63) Continuation of application No. 14/330,087, filed on Jul. 14, 2014, now Pat. No. 9,182,121, which is a continuation of application No. 14/025,325, filed on Sep. 12, 2013, now abandoned.

(51) Int. Cl.

| | |
|---|---|
| ***F23J 7/00*** | (2006.01) |
| ***F23D 1/00*** | (2006.01) |
| ***C10L 9/10*** | (2006.01) |
| ***C10L 10/04*** | (2006.01) |

(52) U.S. Cl.

CPC . *F23J 7/00* (2013.01); *C10L 9/10* (2013.01); *C10L 10/04* (2013.01); *F23D 1/00* (2013.01); *C10L 2200/0209* (2013.01); *C10L 2200/029* (2013.01); *C10L 2200/0213* (2013.01); *C10L 2200/0218* (2013.01); *C10L 2200/0268* (2013.01); *C10L 2290/141* (2013.01); *F23B 2700/023* (2013.01); *F23K 2201/505* (2013.01)

(58) Field of Classification Search

CPC ..... C10L 9/10; C10L 9/12; C10L 10/04; F23J 7/00; F23J 9/00; F23J 15/003; F23K 2201/505

USPC ..... 110/219, 342, 343, 345

See application file for complete search history.

(56) References Cited

U.S. PATENT DOCUMENTS

| | | | | |
|---|---|---|---|---|
| 2,610,112 | A | 9/1952 | Chenicek | |
| 2,800,172 | A | 7/1957 | Romer | |
| 3,999,958 | A | 12/1976 | Iannicelli | |
| 4,173,454 | A | 11/1979 | Heins | |
| 4,491,454 | A | 1/1985 | Lompa-Krzymien | |
| 4,498,402 | A | 2/1985 | Kober et al. | |
| 4,564,369 | A | 1/1986 | Burgess et al. | |
| 4,596,198 | A | 6/1986 | Greskovich et al. | |
| 4,612,177 | A | 9/1986 | Kretchmer et al. | |
| 4,616,574 | A | 10/1986 | Abrams et al. | |
| 4,622,046 | A | 11/1986 | D'Intino et al. | |
| 4,810,362 | A | 3/1989 | Sutton | |
| 4,886,522 | A | 12/1989 | Davidson et al. | |
| 4,952,380 | A | 8/1990 | Najjar et al. | |
| 5,001,994 | A * | 3/1991 | Morimoto | C10B 43/14 110/342 |
| 5,055,029 | A | 10/1991 | Avidan et al. | |
| 5,221,320 | A | 6/1993 | Sinha | |
| 5,304,571 | A | 4/1994 | Johnson et al. | |
| 5,382,267 | A | 1/1995 | Savage et al. | |
| 5,499,587 | A | 3/1996 | Rodriquez et al. | |
| 5,575,824 | A | 11/1996 | Brown et al. | |
| 6,143,261 | A | 11/2000 | Lissy et al. | |
| 6,165,934 | A | 12/2000 | Gardner et al. | |
| 6,773,471 | B2 | 8/2004 | Johnson et al. | |
| 7,162,960 | B2 | 1/2007 | Smyrniotis et al. | |
| 7,775,166 | B2 | 8/2010 | Aradi et al. | |
| 2005/0150441 | A1 * | 7/2005 | Smyrniotis | C10L 9/10 110/342 |
| 2006/0228282 | A1 | 10/2006 | Zhou et al. | |
| 2007/0044693 | A1 | 3/2007 | Smyrniotis et al. | |
| 2010/0006014 | A1 | 1/2010 | Smyrniotis et al. | |

OTHER PUBLICATIONS

Livingston, W.R et al., "The Role of Copper Oxychloride in Reducing Slagging in P.F. Fired Boilers," Inst. of Energy Conf. on "The effectiveness of fuel additives," Oct. 4-5, 1983, 21 pages.

Kiss, L.T. et al., "The use of copper oxychloride to alleviate boiler slagging," J. of the Institute of Fuel, Apr. 1972, 11 pages.

Sanyal, A., "Copper Oxychloride as a Fireside Additive in Coal-Fired Utility Boilers," Electric Power Research Institute, EPRI GS-6751, Project 1839-4, Final Report, Feb. 1990, 122 pages.

"Carton Live Storage is Cool in the Cold Store," Maintenance and Asset Management, vol. 17, No. 6, Dec. 2002/Jan. 2003, 32 pages.

* cited by examiner

*Primary Examiner* — David J Laux

(74) *Attorney, Agent, or Firm* — Richard P. Gilly; Offit Kurman

(57) ABSTRACT

There is provided a process for operating a coal-fired furnace to generate heat. The process has the steps of a) providing the coal to the furnace and b) combusting the coal in the presence of a first slag-reducing ingredient and a second slag-reducing ingredient in amounts effective to reduce slag formation in the furnace. The first slag-reducing ingredient and the second slag-reducing ingredient are different substances. The first slag-reducing ingredient is selected from the group consisting of magnesium carbonate, magnesium hydroxide, magnesium oxide, magnesium sulfate, and combinations thereof. The second slag-reducing ingredient is selected from the group consisting of copper acetate, copper nitrate, aluminum nitrate, aluminum oxide, aluminum hydroxide, and ammonium phosphate. There is also provided a method for reducing slag formation in a coal-fired furnace.

7 Claims, No Drawings

PROCESS FOR OPERATING A COAL-FIRED FURNACE WITH REDUCED SLAG FORMATION

CROSS-REFERENCE TO RELATED APPLICATIONS

The present application is a continuation of co-pending U.S. patent application Ser. No. 14/330,087, filed Jul. 14, 2014. U.S. patent application Ser. No. 14/330,087 is a continuation of U.S. patent application Ser. No. 14/025,325, filed Sep. 12, 2013. U.S. patent application Ser. No. 14/025,325 is a continuation of U.S. patent application Ser. No. 12/319,994, filed Jan. 14, 2009. U.S. patent application Ser. No. 12/319,994 claims priority from U.S. Provisional Patent Application Nos. 61/011,148, filed Jan. 15, 2008, and 61/021,249, filed Jan. 15, 2008. U.S. patent application Ser. Nos. 14/330,087, 14/025,325, and 12/319,994 and U.S. Provisional Patent Application Nos. 61/011,148 and 61/021,249 are incorporated herein by reference.

BACKGROUND OF THE INVENTION

1. Field of the Invention

The present invention relates to a process for operating a coal-fired furnace. The present invention also relates to a process for operating a coal-fired furnace with reduced slag formation. The present invention further relates to a method for reducing slag formation in a coal-fired furnace.

2. Description of the Related Art

Slag builds up on the surfaces and/or walls of furnaces and boilers due to deposition of molten and/or semi-molten ash, which can in turn solidify. Particles of ash are normally molten when they exit the flame zone or radiant section of a boiler or furnace (the terms "furnace" and "boiler" are used interchangeably herein). If the melting point of the ash or the rate of solidification is too low, the particles will not have sufficient time to solidify before impinging on or contacting a surface within the boiler or furnace. When this occurs, the molten or plastic-like ash adheres to and solidifies on the surface, which gives rise to a slag deposit. Fouling can also occur in lower temperature convective sections of the boiler or furnace when volatile components in the ash, such as the alkali oxides, condense and collect further ash, which can sinter into a hard mass.

Typically, the composition and physical properties of ash found in prospective coal feedstocks are considered when designing the size and thermal dynamics of a boiler or furnace. Slag formation can be a particular problem when a coal feedstock is used in a boiler or furnace for which the boiler or furnace was not designed. The size and thermal dynamics of the boiler relative to the composition and physical properties of the ash in the coal feedstock will determine whether the ash is solid or molten by the time it reaches a surface. Desirably, the boiler or furnace is designed such that ash solidifies prior to reaching surfaces within the boiler or furnace. Such solidified ash can be removed relatively easily by means known in the art, such as by physical removal or blowing.

Slag formation occurs to some extent in all boiler and furnace systems. Boilers are often designed for some slag buildup on surfaces and walls to provide an additional measure of thermal insulation, and, thus, minimize heat loss through the walls. Excessive slag buildup, however, tends to clog the boiler or furnace and/or result in excessive temperatures therein.

Slag formation can have a major impact on boiler operation. Significant accumulation of slag can result in partial blockage of the gas flow, possibly requiring reduction in boiler load. Slag may build up to an extent that damage to tubing may result when attempting to dislodge heavy accumulations. Insulation of waterwall tubes may lead to a thermal imbalance within the boiler, heat transfer efficiency reductions, and excessively high temperatures in the superheat section.

Boilers are generally designed around a specified range of coal properties, depending on the expected source of fuel. Many consumers are forced to switch their normal supplies because of increased demand for coal. Additionally, more stringent regulations regarding emissions may make a change in fuel more desirable than adding control systems. Alternate coal supplies may be completely different from design fuel with regard to ash fusion temperature, ash composition, etc. Substitution of a coal with ash characteristics significantly different from those for which a boiler was designed can give rise to problems such as slagging.

Many factors are considered in designing a boiler capable of handling the ash characteristics of a particular coal. Design considerations are very important in determining whether deposits will form when a particular fuel is burned. Design considerations are geared to optimize the combustion process and reduce deposits to a minimum thus maximizing the efficiency of extraction of energy from the fuel. Careful control of the relative quantities absorbed through the various boiler sections is necessary.

A method commonly used in the art to reduce slag formation during on-line operations is soot blowing. However, soot blowing usually only partially alleviates the problem of slag formation.

Another method of reducing slag formation while on-line is to reduce boiler or furnace load. During reduction of boiler load, temperatures are reduced and molten ash solidifies faster, i.e., prior to reaching boiler/furnace walls. Also, the temperature reduction can cause a difference in contraction rates between metal in the tubes and the slag and cause slag to be separated from tube surfaces. Notwithstanding the foregoing, reduction of boiler load is economically undesirable due to lost capacity.

Another method used in the art to reduce slag formation while on-line is the use of attemperating spray, which reduces steam temperatures. As tubes begin to encounter slag formation, excessively high steam temperatures in the superheat and/or reheat sections of the boiler or furnace may necessitate the use of an attemperating spray. If slagging continues to increase, the amount of spray must be increased. Since the level of attemperating spray usage is proportional to the degree of slag formation, it can serve as a useful measure of the severity of the slag formation. When maximum spray is reached and steam temperatures are still too high, thermal balance can be restored by reducing load and shedding or removing slag.

It would be desirable to have a process for operating a coal-fired furnace exhibiting reduced slag formation. It would also be desirable to have a method for reducing slag formation in a coal-fired furnace.

SUMMARY OF THE INVENTION

According to the present invention, there is provided a process for operating a coal-fired furnace to generate heat. The process has the steps of a) providing the coal to the furnace and b) combusting the coal in the presence of a first slag-reducing ingredient and a second slag-reducing ingredient in amounts effective to reduce slag formation in the furnace. The first slag-reducing ingredient is selected from the group consisting of magnesium carbonate, magnesium hydroxide, magnesium oxide, magnesium sulfate, and combinations thereof. The second slag-reducing ingredient is selected from the group consisting of copper acetate, copper nitrate, aluminum nitrate, aluminum oxide, aluminum hydroxide, ammonium phosphate, and combinations thereof.

Further according to the present invention, there is provided a method for reducing slag formation in a coal-fired furnace. The method has the step of combusting coal in the furnace in the presence of a first slag-reducing ingredient and a second slag-reducing ingredient in amounts effective to reduce slag formation in the furnace. The first slag-reducing ingredient is selected from the group consisting of magnesium carbonate, magnesium hydroxide, magnesium sulfate, magnesium oxide, and combinations thereof. The second slag-reducing ingredient is selected from the group consisting of copper acetate, copper nitrate, aluminum nitrate, aluminum oxide, aluminum hydroxide, ammonium phosphate, and combinations thereof.

DETAILED DESCRIPTION OF THE INVENTION

The present invention affords reduced slagging in the operation of coal-fired furnaces.

The first slag-reducing ingredient functions to reduce slag formation relative to combustion without such first slag-reducing ingredient. The first slag-reducing ingredient is selected from among magnesium carbonate, magnesium hydroxide, magnesium sulfate, magnesium oxide, and combinations thereof. A preferred first slag-reducing ingredient is magnesium hydroxide. The first slag-reducing ingredient may also function as a combustion catalyst to improve the oxidation of the coal.

The second slag-reducing ingredient acts synergistically with the first slag-reducing ingredient to significantly reduce slag formation relative to combustion with the first slag-reducing ingredient alone. The rate of formation of slag with the second slag-reducing ingredient is preferably reduced by a factor of about 10 to about 100 compared to the presence of the first slag-reducing ingredient alone.

The second slag-reducing ingredient is selected from among copper acetate, copper nitrate, aluminum nitrate, aluminum oxide, aluminum hydroxide, and ammonium phosphate. Preferred ingredients are copper acetate, copper nitrate, and a combination thereof.

The first and second slag-reducing ingredients are added to the coal in amounts preferably up to about 2000 ppm based upon the weight of ash in the coal, which is typically about 2 wt % to about 3 wt % of the total weight of the coal. The composition and proportion of ash in the coal will vary from coal sample to coal sample. The indicated upper limit is preferred due to economic considerations, but higher amounts are operable and possible. A more preferred range is about 100 ppm to about 1000 ppm based upon the weight of the coal as received. A most preferred range is about 500 ppm to about 750 ppm based upon the weight of the coal as received. The ratio of the first slag-reducing ingredient to the second slag-reducing ingredient preferably ranges from about 95:5 to about 60:40 and more preferably about 90:10 to about 80:20.

The first and second ingredients may be added directly into the furnace or boiler in powder or liquid forms or added to the coal as received prior to conveyance of the coal to the furnace or boiler. Suitable liquid forms include solutions and slurries. A preferred solvent or vehicle is water. A liquid is preferably sprayed onto the coal prior to bunkering or in the gravimetric feeders prior to pulverization or prior to the cyclone.

It should be understood that the foregoing description is only illustrative of the present invention. Various alternatives and modifications can be devised by those skilled in the art without departing from the invention. Accordingly, the present invention is intended to embrace all such alternatives, modifications and variances that fall within the scope of the appended claims.

What is claimed is:

1. A method for reducing slag formation in a coal-fired furnace, comprising:

combusting coal in the furnace in the presence of a first slag-reducing ingredient and a second slag-reducing ingredient in amounts effective to reduce slag formation in the furnace;

wherein the first slag-reducing ingredient comprises magnesium;

wherein the second slag-reducing ingredient comprises copper; and wherein the ratio of the first slag-reducing ingredient to the second slag-reducing ingredient ranges from about 95:5 to about 60:40.

2. The method of claim 1, wherein the first slag-reducing ingredient is magnesium hydroxide.

3. The method of claim 1, wherein the second slag-reducing ingredient is selected from the group consisting of copper acetate, copper nitrate, and a combination thereof.

4. The method of claim 1, wherein the first and second slag-reducing ingredients are present at up to about 2000 ppm by weight based upon the weight of the coal as received.

5. The method of claim 1, wherein the first and second slag-reducing ingredients are present at from about 100 ppm to about 1000 ppm by weight based upon the weight of the coal as received.

6. The method of claim 1, wherein the ratio of the first slag-reducing ingredient to the second slag-reducing ingredient ranges from about 90:10 to about 80:20.

7. The method of claim 1, wherein rate of formation of slag is reduced by a factor of about 10 to about 100 compared to the presence of the first slag-reducing ingredient alone.

* * * * *